US007758723B2

(12) United States Patent
Vinson et al.

(10) Patent No.: US 7,758,723 B2
(45) Date of Patent: Jul. 20, 2010

(54) PROCESSES FOR FORESHORTENING FIBROUS STRUCTURES

(75) Inventors: Kenneth Douglas Vinson, Toone, TN (US); John Allen Manifold, Milan, IN (US); Michael Scott Prodoehl, West Chester, OH (US); Jonathan Andrew Ficke, Norwich, NY (US); James Edwin Cartledge, Jr., Liberty Township, OH (US)

(73) Assignee: The Procter + Gamble Company, Cincinnati, OH (US)

( * ) Notice: Subject to any disclaimer, the term of this patent is extended or adjusted under 35 U.S.C. 154(b) by 492 days.

(21) Appl. No.: 11/799,932

(22) Filed: May 3, 2007

(65) Prior Publication Data

US 2007/0251656 A1 Nov. 1, 2007

Related U.S. Application Data

(63) Continuation-in-part of application No. 11/016,521, filed on Dec. 17, 2004, now Pat. No. 7,229,528.

(60) Provisional application No. 60/531,211, filed on Dec. 19, 2003.

(51) Int. Cl.
*D21H 27/40* (2006.01)

(52) U.S. Cl. ..... 162/111; 428/153

(58) Field of Classification Search ..... 162/109–117, 162/280, 281; 428/152–154
See application file for complete search history.

(56) References Cited

U.S. PATENT DOCUMENTS

| | | | | |
|---|---|---|---|---|
| 6,197,154 | B1 * | 3/2001 | Chen et al. | 162/109 |
| 6,419,789 | B1 * | 7/2002 | Yeh et al. | 162/109 |
| 6,436,234 | B1 * | 8/2002 | Chen et al. | 162/109 |
| 7,449,085 | B2 * | 11/2008 | Hermans et al. | 162/109 |
| 2005/0133176 | A1 | 6/2005 | Vinson et al. | |

* cited by examiner

*Primary Examiner*—Eric Hug
(74) *Attorney, Agent, or Firm*—G. Brant Cook

(57) ABSTRACT

Papermaking processes and more particularly to papermaking processes for foreshortening fibrous structures are provided.

5 Claims, 2 Drawing Sheets

PROCESSES FOR FORESHORTENING FIBROUS STRUCTURES

CROSS REFERENCE TO RELATED APPLICATIONS

Figure 1:
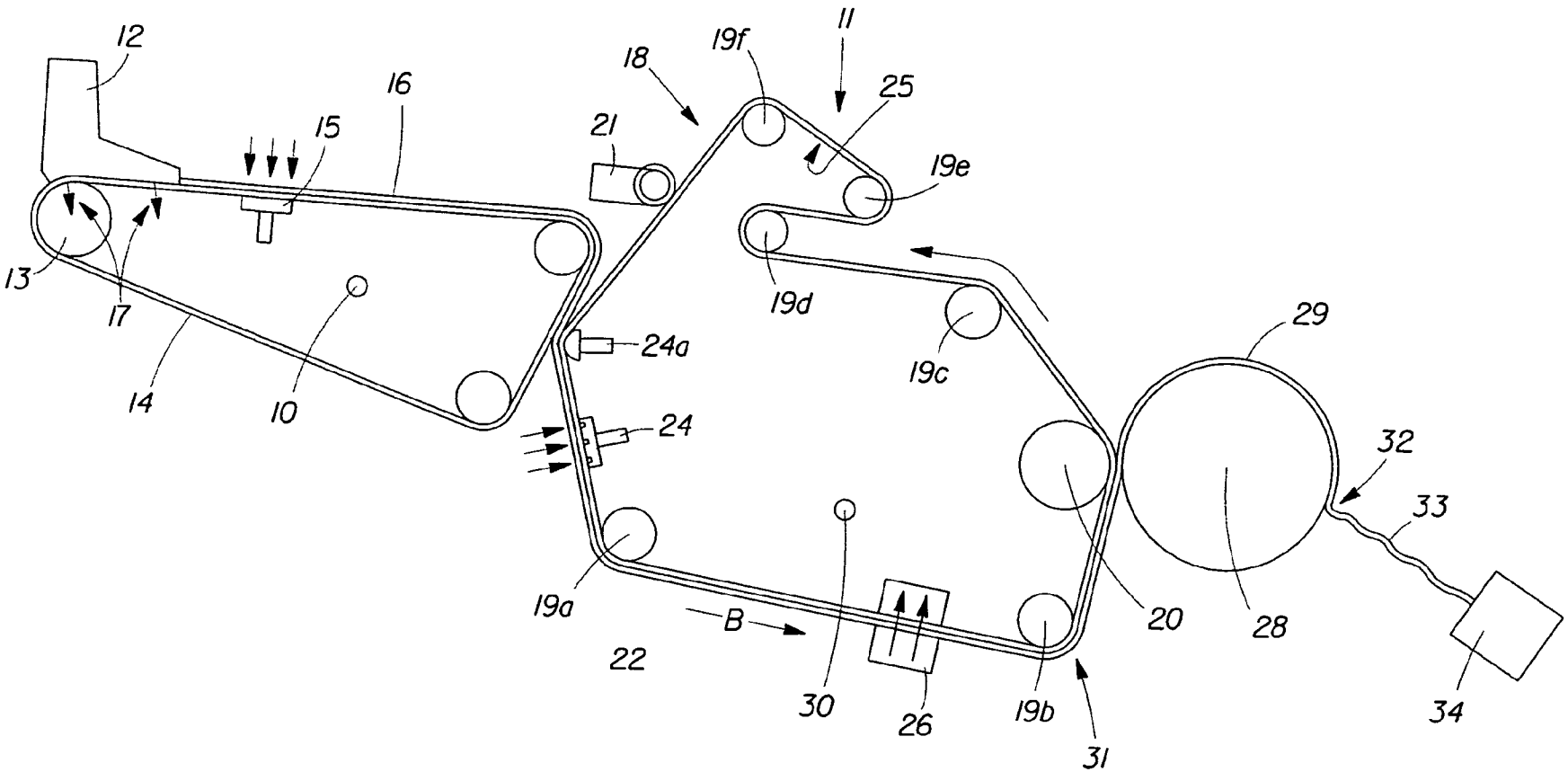

This application is a continuation-in-part of U.S. application Ser. No. 11/016,521, now U.S. Pat. No. 7,229,528. filed Dec. 17, 2004, which claims the benefit of U.S. Provisional Application No. 60/531,211 filed Dec. 19, 2003.

FIELD OF THE INVENTION

The present invention relates to papermaking processes and more particularly to papermaking processes for foreshortening fibrous structures.

BACKGROUND OF THE INVENTION

Foreshortening of fibrous structures has been known. Foreshortening has been used in the past to increase a fibrous structure's caliper, absorbency and/or softness. Unfortunately, foreshortening is accompanied by some well-known negative side effects, including process reliability as well as productivity, i.e. the achievable production speed of the papermaking process.

Achieving a low level of foreshortening is facilitated by operating at high machine-direction tensile (MDT) values or by minimizing basis weight (BW). Accordingly, there is a need for a papermaking process for total foreshortening of fibrous structures by an amount less than about 29%+[6%×ln(BW/MDT)].

Foreshortening of the fibrous structure after drying, so-called "dry-end foreshortening", is particularly degradative to productivity and reliability. Accordingly, there is alternatively a need for a papermaking process for dry-end foreshortening of fibrous structures by an amount less than about 48%+[14.5%×ln(BW/MDT)].

SUMMARY OF THE INVENTION

The present invention fulfills the need described above by providing novel papermaking processes for foreshortening fibrous structures.

In one aspect of the present invention, a process for foreshortening a fibrous structure, the process comprising the steps of:

a. forming a wet fibrous structure comprising greater than 60% moisture;
b. drying the wet fibrous structure such that the dried fibrous structure comprises less than 20% moisture; and
c. total foreshortening of the fibrous structure by an amount greater than 0 but less than about 29%+[6%×ln(BW/MDT)], is provided.

The steps of this process may occur in any order.

In another aspect of the present invention, a process for foreshortening a fibrous structure, the process comprising the steps of:

a. forming a wet fibrous structure comprising greater than 60% moisture;
b. drying the wet fibrous structure such that a dried fibrous structure comprising less than 20% moisture is formed; and
c. dry-end foreshortening the dried fibrous structure by an amount less than 48%+[14.5%×ln(BW/MDT)], is provided.

In yet another aspect of the present invention, a process for foreshortening a fibrous structure, the process comprising the steps of:

a. total foreshortening a fibrous structure by an amount greater than 0 but less than about 29%+[6%×ln(BW/MDT)];
b. providing a cylindrical dryer to which the fibrous structure is releasably attached; and
c. providing a conveyor system comprising at least one conveyor, wherein the conveyor system receives the fibrous structure from the cylindrical dryer and advances the fibrous structure to a reel; is provided.

In still another aspect of the present invention, a process for foreshortening a fibrous structure, the process comprising the steps of:

a. providing a cylindrical dryer to which the fibrous structure is releasably attached; and
b. providing a conveyor system comprising at least one conveyor, wherein the conveyor system receives the fibrous structure from the cylindrical dryer and advances the fibrous structure to a reel;

wherein the process further comprises dry-end foreshortening the fibrous structure by an amount less than about 48%+[14.5%×ln(BW/MDT)]; is provided.

In even another aspect of the present invention, a process for foreshortening a fibrous structure, the process comprising the steps of:

a. total foreshortening a fibrous structure by an amount greater than 0 but less than about 29%+[6%×ln(BW/MDT)];
b. providing a cylindrical dryer to which the fibrous structure is releasably attached;
c. providing a conveyor system comprising at least one conveyor, wherein the conveyor system receives the fibrous structure from the cylindrical dryer and advances the fibrous structure to a reel; and
d. subjecting the fibrous structure to a caliper generating system between the cylindrical dryer and the reel, wherein the caliper generating system comprises subjecting the fibrous structure to a temperature above its web flexibilization temperature and subsequently subjecting the fibrous structure to a temperature below its web flexibilization temperature; is provided.

In still yet another aspect of the present invention, a process for foreshortening a fibrous structure, the process comprising the steps of:

a. providing a cylindrical dryer to which the fibrous structure is releasably attached;
b. providing a conveyor system comprising at least one conveyor, wherein the conveyor system receives the fibrous structure from the cylindrical dryer and advances the fibrous structure to a reel; and
c. subjecting the fibrous structure to a caliper generating system between the cylindrical dryer and the reel, wherein the caliper generating system comprises subjecting the fibrous structure to a temperature above its web flexibilization temperature and subsequently subjecting the fibrous structure to a temperature below its web flexibilization temperature;

wherein the process further comprises dry-end foreshortening the fibrous structure by an amount less than about 48%+[14.5%×ln(BW/MDT)]; is provided.

In even yet another aspect of the present invention, a process for treating a fibrous structure in need of treatment, the process comprising the steps of:

a. providing a fibrous structure having less than about 25% moisture content by weight of the fibrous structure;

b. subjecting the fibrous structure to a caliper generating system comprising wherein the caliper generating system comprises subjecting the fibrous structure to a temperature above its web flexibilization temperature and subsequently subjecting the fibrous structure to a temperature below its web flexibilization temperature, such that the fibrous structure is treated, is provided.

For the processes of the present invention that comprise subjecting a fibrous structure to a caliper generating system, it is desirable that the fibrous structure has a moisture content of from about 7% and/or 10% to about 25% and/or to about 23% by weight of the fibrous structure.

In even yet another aspect of the present invention, a fibrous structure made by a process of the present invention, is provided.

In still even another aspect of the present invention, a sanitary tissue product comprising a fibrous structure made by a process according to the present invention, is provided.

Accordingly, the present invention provides processes for making foreshortened fibrous structures and fibrous structures made therefrom.

BREIF DESCRIPTION OF THE DRAWINGS

Figure 2:
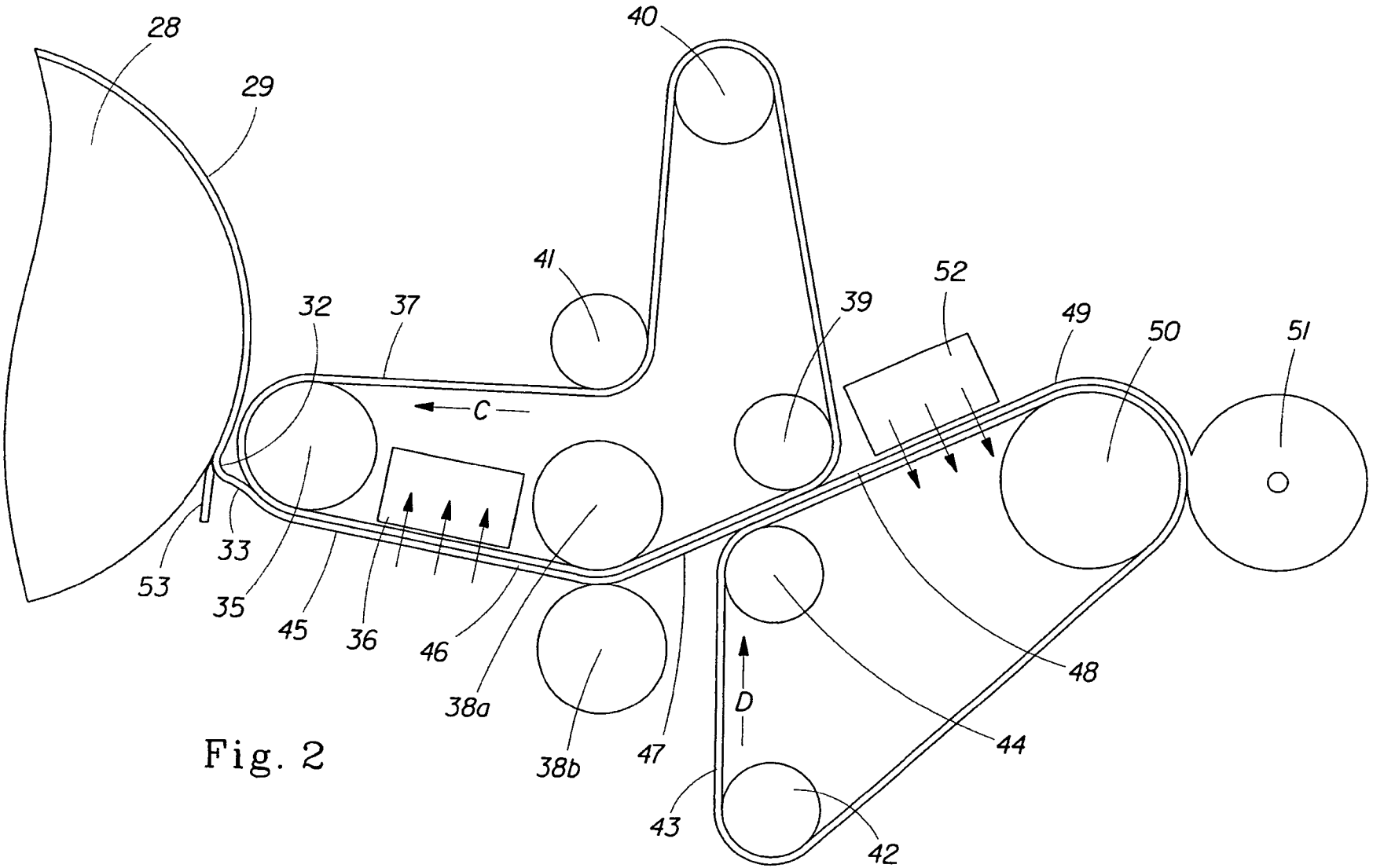

FIG. 1 is a schematic representation of one embodiment of a papermaking machine suitable for performing the processes of the present invention; and FIG. 2 is a schematic representation of one embodiment of a dry-end section of the papermaking machine incorporating a dry-end conveyance process suitable for performing the processes of the present invention.

DETAILED DESCRIPTION OF THE INVENTION

Definitions

"Foreshortening" as used herein means the reduction in length of a formed fibrous structure resulting from decelerating the fibrous structure as it transfers from an upstream point of the papermaking device to a downstream point. Foreshortening may occur at any point between the wet end and the dry end of a papermaking process. Foreshortening, as used herein, is calculated by the following formula:

$$1-(\text{speed at downstream point}/\text{speed at upstream point})$$

Typically, during foreshortening of the fibrous structure, rearrangement of the fibers in the fibrous structure occurs, oftentimes accompanied by partial disruption of fiber-to-fiber bonds. Foreshortening can be accomplished in any one of several ways. The most common method is creping from a cylinder surface, in which method a dried fibrous structure is adhered to a smooth surface, typically the surface of the Yankee dryer drum, and then removed from the surface with a doctor blade. Alternatively, foreshortening may be accomplished via wet-microcontraction, as taught in commonly-assigned U.S. Pat. No. 4,440,597 issued Apr. 3, 1984 to Wells et al.

As used herein, there are two classes of foreshortening: 1) total foreshortening which references the "reel" as the downstream point and the "forming wire" as the upstream point, and 2) dry-end foreshortening which references the "reel" as the downstream point and the point at which the fibrous structure attains less than 20% moisture as the upstream point.

As used herein, the term "forming wire" refers to the foraminous surface upon which the fibrous slurry is deposited for wet forming. For machines comprising multiple wires in the forming zone, the "forming wire" is the surface which passes the largest quantity of water among the multiple wires.

As used herein, the term "reel" refers to the parent roll being wound at the end of the papermaking process. The "reel" can be driven by a reel drum, so-called surface driven winding, and/or it can be driven through the spool at the center of the parent roll.

Total foreshortening is always a positive value as used herein. Dry end foreshortening is also often a positive value, although negative values are expressly permitted. A negative value for foreshortening merely indicates that the fibrous structure is being subjected to a "draw" is taking place rather than a compaction. All fibrous structures of the present invention have positive total forshortening irrespective or whether the dry-end forshortening is a positive or a negative value. In other words, all fibrous structure of the present invention have been total foreshortened by an amount greater than 0.

"Web flexibilization temperature" as used herein means the temperature above which the fibrous structure can be plastically deformed. Without being bound by theory, inventors believe this to be related to the glass transition temperature of the constituent cellulosic material. Web flexibilization temperature is a function of moisture content as follows:

$$T_f=(-1414\times M/100+210.4)/(6.16\times M/100+1)$$

wherein, $T_f$ is the web flexibilization temperature in degrees C and M is the moisture content of the fibrous structure in percent. M or "moisture content" is determined by any method equivalent to that which would be determined by drying overnight in a 105° C. oven.

"Fiber" as used herein means an elongate particulate having an apparent length greatly exceeding its apparent width, i.e. a length to diameter ratio of at least about 10. More specifically, as used herein, "fiber" refers to papermaking fibers. The present invention contemplates the use of a variety of papermaking fibers, such as, for example, natural fibers or synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking. In addition to the above, fibers and/or filaments made from polymers, specifically hydroxyl polymers may be used in the present invention. Nonlimiting examples of suitable hydroxyl polymers include polyvinyl alcohol, starch, starch derivatives, chitosan, chitosan derivatives, cellulose derivatives, gums, arabinans, galactans and mixtures thereof.

"Fibrous structure" as used herein means a fiber-containing structure such as a web.

"Sanitary tissue product" as used herein means a soft, low density (i.e. <about 0.15 g/cm3) web useful as a wiping implement for post-urinary and post-bowel movement cleaning (toilet tissue), for otorhinolaryngological discharges (facial tissue), and multi-functional absorbent and cleaning uses (absorbent towels).

"Basis Weight" as used herein is the weight per unit area of a sample reported in lbs/3000 $ft^2$. Basis weight is measured by preparing one or more samples of a certain area ($m^2$) and weighing the sample(s) of a fibrous structure according to the present invention and/or a paper product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$). The basis weight ($g/m^2$) is calculated by dividing the average weight (g) by the average area of the samples ($m^2$). The applicable conversion factor (0.6144 lb/3000 $ft^2/g/m^2$) can be applied to convert this value to the "Basis Weight", in lb/3000 $ft^2$ used in this specification, and abbreviated "BW" in the mathematical formulae contained herein. "BW" always refers to the basis weight of the fibrous structure as it is taken from the reel and measured after conditioning according to TAPPI Method 402.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or paper product comprising the fibrous structure.

"Total Dry Tensile Strength" or "TDT" of a fibrous structure of the present invention and/or a paper product comprising such fibrous structure is measured as follows. One (1) inch by five (5) inch (2.5 cm×12.7 cm) strips of fibrous structure and/or paper product comprising such fibrous structure are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The MDT is the tensile strength of the MD strips. The CDT is the tensile strength of the CD strips and the TDT is the arithmetic total of MD and CD tensile strengths of the strips. "MDT" as used in the mathematical formulae herein always refers to the tensile as measured on the finished conditioned paper product and it is used in units of g/in in the formulae herein.

"BW/MDT" as used in the formulae herein is the BW number in lb/3000 $ft^2$ units (but used without dimensions in this ratio) over the MDT number in g/in units (but used without dimensions in this ratio) so that the resulting quotient is a dimensionless/unitless number.

"Caliper" as used herein means the macroscopic thickness of a sample. Caliper of a sample of fibrous structure according to the present invention is determined by cutting a sample of the fibrous structure such that it is larger in size than a load foot loading surface where the load foot loading surface has a circular surface area of about 3.14 $in^2$. The sample is confined between a horizontal flat surface and the load foot loading surface. The load foot loading surface applies a confining pressure to the sample of 15.5 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

"Apparent Density" or "Density" as used herein means the basis weight of a sample divided by the caliper with appropriate conversions incorporated therein. Apparent density used herein has the units $g/cm^3$.

"Ply" or "Plies" as used herein means an individual fibrous structure optionally to be disposed in a substantially contiguous, face-to-face relationship with other plies, forming a multiple ply fibrous structure. It is also contemplated that a single fibrous structure can effectively form two "plies" or multiple "plies", for example, by being folded on itself.

Fibrous Structure

The fibrous structure (web) of the present invention may be incorporated into a single-ply or multi-ply sanitary tissue product.

The fibrous structures of the present invention are useful in paper, especially sanitary tissue paper products including, but not limited to: conventionally felt-pressed tissue paper; pattern densified tissue paper; and high-bulk, uncompacted tissue paper. The tissue paper may be of a homogenous or multilayered construction; and tissue paper products made therefrom may be of a single-ply or multi-ply construction. The tissue paper preferably has a basis weight of between about 10 $g/m^2$ and about 120 $g/m^2$, and density of about 0.60 g/cc or less. Preferably, the basis weight will be below about 35 $g/m^2$; and the density will be about 0.30 g/cc or less. Most preferably, the density will be between about 0.04 g/cc and about 0.20 g/cc as measured by the Basis Weight Method described herein.

The fibrous structure may be made with a fibrous furnish that produces a single layer embryonic fibrous web or a fibrous furnish that produces a multi-layer embryonic fibrous web.

The fibrous structures of the present invention and/or paper products comprising such fibrous structures may have a total dry tensile of greater than about 59 g/cm (150 g/in).

In one embodiment, the total dry tensile of a fibrous structure in accordance with the present invention is from about 78 g/cm (200 g/in) to about 394 g/cm (1000 g/in) and/or from about 98 g/cm (250 g/in) to about 335 g/cm (850 g/in).

In another embodiment, the total dry tensile of a fibrous structure in accordance with the present invention is from about 196 g/cm (500 g/in) to about 670 g/cm (1700 g/in).

In still another embodiment, the total dry tensile of a fibrous structure in accordance with the present invention is from about 294 g/cm (750 g/in) to about 1005 g/cm (2550 g/in).

All the total dry tensile values are as measured by the Total Dry Tensile Method described herein.

The ratio of MDT to CDT of fibrous structures made according to the present invention can acceptably be from about 1:1.2 to about 10:1.

Papermaking Processes

The papermaking process used to produce the fibrous structure of the present invention may include any suitable steps known in the art.

The papermaking processes of the present invention can typically be performed by any suitable papermaking machine known in the art. Generally, papermaking machines include a wet-end and a dry-end.

One embodiment of a papermaking machine is shown in FIG. 1. As shown in FIG. 1, the wire section unit operation 10 comprises a headbox 12 which contains a pulp furnish comprising fibers. The headbox 12 is adapted to deliver the pulp furnish to a foraminous wire 14 at the position of breast roll 13 equipped with a permeable covering and which may optionally be equipped with internal vacuum. A wet fibrous structure 16 is separated from carrier water, referred to as white water 17 by breast roll 13 further gravity drainage, and optionally assisted by an active or passive vacuum device shown at position 15. After dewatering, wet fibrous structure 16 may continue to have greater than about 60% moisture therein. From the foraminous wire 14, the wet fibrous structure 16 is transferred to a transfer belt or fabric in the form of an endless loop 18. The transfer belt 18 has a web contacting side 11 and a backside 25 opposite the web contacting side 11. The belt 18 carries the web in various stages of its formation. The belt 18 travels in the direction indicated by directional arrow B around the return rolls 19*a* and 19*b* impression roll 20 return rolls 19*c*, 19*d*, 19*e* and 19*f* and emulsion distributing roll 21. The loop around which the papermaking belt 18 travels includes a means for applying a fluid pressure differential to the wet web 16 such as vacuum pick-up shoe 24*a* and multislot vacuum box 24 in order to further dewater wet web 16. In addition to acting as a dewatering point, the wet web 16 transfers from wet end unit to press section unit at the vacuum pick-up shoe 24*a*. The wet web 16 after transferring at 24*a* and being subjected to further dewatering by 24*a* and 24 becomes wet web 22 residing on transfer belt 18. Carrier belt 18 with wet web 22 on its surface 11 can optionally pass through a further dewatering step, illustrated in FIG. 1 as a predryer 26 which can be a hot air blow through dryer. Predryer 26 can be cylindrical in form and/or it can be comprised of multiple units. Wet web 22 after being subjected to further drying of dryer 26 can be referred to as semi-dry web 31. Semi-dry web 31 transfers from carrier belt 18 to the surface of cylinder dryer 28 aided by impression roll 20. This transfer can be accomplished by applying a nip force between roll 20 and dryer 28 or other means such as using a permeable cover on roll 20 and air couching web 31 to surface of dryer 28. The dryer 28 converts semi-dry web 31 to a further dried web 29. The further dried web 29 is removed from the cylinder dryer at point 32. Means to remove web 29 at point 32 include dislodgement by a doctor blade or simply pulling web 29 from dryer 28 surface by some force such as tension in the web or fluid pressure difference. Dried web 33 is then transferred to a dry end conveyance 34. Dry end conveyance 34 may be an open draw, or it may comprise active or passive foils, idlers, driven rolls, spreader rolls, calender rolls, and the like.

One example of an arrangement for dry end conveyance 34 is illustrated in FIG. 2. In FIG. 2, further dried web 29 on surface of dryer 28 is removed at point 32 by optional doctor blade 53 yielding free web 33. Web 33 is picked up on permeable fabric 37 moving in the direction suggested by directional arrow C at turning roll 35 which is optionally equipped with a permeable cover and internal active vacuum system. Web 33 becomes web 45 restrained on the surface of fabric 37. Device 36 is an active or passive vacuum device which creates an air flow in the direction of the arrows in box 36 which acts to hold web 45 on fabric 37. In one embodiment, web 45 is at and/or subjected to a temperature above the web flexibilization temperature and force indicated by the air flow of the arrows of box 36 is sufficient to deflect web 45 into fabric 37 causing an increase in caliper of web which becomes thickened web 46. The composite web 46 on fabric 37 is passed through calender rolls 38*a* and 38*b*. Preferably, web 46 is above the web flexibilization temperature and the design of fabric 37 and the pressure induced by the nip between rolls 38*a* and 38*b* is sufficient to cause an increase in caliper of web 46 which becomes increased caliper web 47. Rolls 38*a* and 38*b* can be smooth in construction or one or both of the rolls can be textured to facilitate a caliper increase. Executions wherein there is a caliper decrease at calender roll 38*a* and 38*b* are generally less preferred but still within the scope of the present invention. Further increased caliper web 47 enters the gap between fabric 37 and fabric 43 traveling the direction of arrow D. Preferably fabric 43 is traveling slightly faster than fabric 37. Web 48 emerges from the overlap of fabrics 37 and 43 at which point fabric 37 returns guided by turning rolls 39, then passes through optional device 52 for transforming web 48 from a condition above the web transition temperature to web 49 which is in a condition below the web transition temperature Device 52 can be a dryer, for example a through air dryer or infrared dryer or it could be a cooling device, or it could incorporate both drying and cooling effects in a combination necessary to bring the web below the web flexibilization temperature. Web 49 is separated from fabric 43 and is wound onto parent roll 51. Fabric 43 returns around rolls 50, 42 and 44.

Web speed at positions 16, 22, 29 and 34 is often essentially constant within each respective zone, i.e. within wire unit 10, press unit 30, cylinder unit 28, and conveyance unit 34, while differing between some or all units. Foreshortening occurs when any of the downstream unit speed differs from one of the upstream units. Positive foreshortening refers to deceleration of the web. Although web speed generally stays constant within a zone, it is envisioned that the web could change speed within a zone, for example within press unit 30, if belt 18 were to be constructed from extensible material and changed speed between some or all of rolls 19*a*, 19*b*, 19*c*, 19*d*, 19*e*, 19*f* or 20. In such a case, foreshortening would occur within a zone as well as optionally between zones. Another common example of foreshortening within a zone could occur, for example, within dry end conveyance 34 if it comprises zones within which the web transfers from a device (calender, conveyor, idler, driven roll for example) to another device traveling at a different speed.

Foreshortening

Foreshortening of the fibrous structure may occur by any suitable foreshortening technology known in the art. For example, foreshortening may occur by rush transferring the fibrous structure during the papermaking process, especially when the fibrous structure contains greater than about 60% moisture; foreshortening may occur by subjecting the fibrous structure to microcontraction as described in U.S. Pat. No. 4,440,597; foreshortening may occur by subjecting the fibrous structure to a microcreping operation such as by contacting the fibrous structure with a Micrex microcreping device, commercially available from Micrex; foreshortening, especially dry-end foreshortening may occur by creping the fibrous structure, which is releasably attached to a surface, such as a cylindrical dryer, off the surface by a doctor blade. Foreshortening may occur prior to and/or after any drying step in the papermaking process.

Total foreshortening of the fibrous structure by an amount of from about 0 to about 2% may be provided by a doctor blade, when present.

Conveyor System

Dry end conveyors for foreshortened webs are well known in the art. These typically comprise one or more porous surfaces, so-called "conveyor fabrics", with means, generally vacuum, for retaining the dried cellulose web so that it can be releasably carried from a drying means to a reel, or spool upon which the finished parent roll is wound. A conveyor system for the practice of the present invention has at least one and optionally two or more carrier fabrics. An acceptable conveyor system for use in the present invention is described in Linkletter U.S. Pat. No. 4,087,319. While Linkletter shows the primary conveyor fabric accepting the dried web from a drying means to reside on the lower side of dried web, it is also acceptable for the conveyor system to comprise a conveyor fabric accepting the web on its lower surface, i.e. the dried cellulose web can be carried on either the top side and/or bottom side of conveyor fabrics. The dried cellulose web can be transferred to the conveyor fabric directly from a drying means, for example, a Yankee drum, i.e. without an open draw. Alternatively, the dried web may be transferred from a drying means to a conveyor fabric over an open draw. Air wash or vacuum or both may be used to urge the web across any open draw onto the conveyor fabric. Wide latitude is permissible in the porosity and smoothness of the conveyor fabrics. Most preferably, at least one of the conveyor fabrics would have caliper building capability. This means that the conveyor fabric has deflection conduits capable of allowing deflection of the dried cellulose web while it is being carried upon its surface.

Preferably, the web is deflected into this caliper-building conveyor fabric while the web is above the web flexibilization temperature. Then, prior to removal of the web from the fabric, i.e. prior to winding onto the reel, the web temperature is reduced below the web flexibization temperature by cooling and/or drying.

The fibrous structure of the present invention at a reel may exhibit a caliper that is greater than the caliper of the dried fibrous structure at the point of transfer of the dried fibrous structure to the conveyor system.

Ingredients

One or more ingredients may be added to the fibrous structure at any point in the papermaking process.

In one embodiment, an ingredient is added to the fibrous structure prior to drying the fibrous structure.

In another embodiment, an ingredient is added to the fibrous structure after drying the fibrous structure.

In still another embodiment, an ingredient is added to a dried fibrous structure between a conveyor system and a reel.

In yet another embodiment, an ingredient is added to a dried fibrous structure prior to a reel.

Permanent Wet Strength Resins

The TAD fibrous structure of the present invention may comprise a permanent wet strength resin. The permanent wet strength resin may be present in the fibrous furnish, particularly, the long fiber furnish used to form the TAD fibrous structure and/or can be deposited onto the embryonic fibrous web prior to through-air drying of the embryonic fibrous web.

The permanent wet strength resins act to control Tinting and also to offset the loss in tensile strength, if any, resulting from any chemical softeners added to the fibrous structure. Further, the permanent wet strength resins give the fibrous structure or paper product it is incorporated into a property such that when it is placed in an aqueous medium it retains a substantial portion of its initial wet strength over time Nonlimiting examples of permanent wet strength resins include: polyamide-epichlorohydrin resins, polyacrylamide resins, styrenebutadiene resins; insolubilized polyvinyl alcohol resins; urea-formaldehyde resins; polyethyleneimine resins; chitosan resins and mixtures thereof. Preferably, the permanent wet strength resins are selected from the group consisting of polyamide-epichlorohydrin resins, polyacrylamide resins and mixtures thereof.

Polyamide-epichlorohydrin resins are cationic wet strength resins which have been found to be of particular utility. Suitable types of such resins are described in U.S. Pat. No. 3,700,623, issued on Oct. 24, 1972, and U.S. Pat. No. 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the trade-mark KYMENE ® 557H.

Polyacrylamide resins have also been found to be of utility as wet strength resins. These resins are described in U.S. Pat. No. 3,556,932, issued on Jan. 19, 1971, to Coscia, et al. and U.S. Pat. No. 3,556,933, issued on Jan. 19, 1971, to Williams et al., both patents being incorporated herein by reference. One commercial source of polyacrylamide resins is CYTEC Co. of Stanford, Conn., which markets one such resin under the trade-mark PAREZ® 631 NC. Still other water-soluble cationic resins finding utility in this invention are urea formaldehyde and melamine formaldehyde resins.

Chemical Softeners:

The TAD fibrous structure of the present invention may comprise a chemical softener. As used herein, the term "chemical softener" and/or "chemical softening agent" refers to any chemical ingredient which improves the tactile sensation perceived by the user whom holds a particular paper product and rubs it across her skin. Although somewhat desirable for towel products, softness is a particularly important property for facial and toilet tissues. Such tactile perceivable softness can be characterized by, but is not limited to, friction, flexibility, and smoothness, as well as subjective descriptors, such as a feeling like lubricious, velvet, silk or flannel.

Chemical softening agent is any chemical ingredient which imparts a lubricious feel to tissue. This includes, for exemplary purposes only, basic waxes such as paraffin and beeswax and oils such as mineral oil and silicone oils and silicone gels as well as petrolatum and more complex lubricants and emollients such as quaternary ammonium compounds with long (C10-C22) hydrocarbyl chains, functional silicones, and long (C10-C22) hydrocarbyl chain-bearing compounds possessing functional groups such as amines, acids, alcohols and esters.

The field of work in the prior art pertaining to chemical softeners has taken two paths. The first path is characterized by the addition of softeners to the tissue paper web during its formation either by adding an attractive ingredient to the vats of pulp which will ultimately be formed into a tissue paper web, to the pulp slurry as it approaches a paper making machine, or to the wet web as it resides on a Fourdrinier cloth or dryer cloth on a paper making machine.

The second path is categorized by the addition of chemical softeners to tissue paper web after the web is partially or completely dried. Applicable processes can be incorporated into the paper making operation as, for example, by spraying onto the embryonic web and/or dried fibrous structure before it is wound into a roll of paper, extruding, especially via slot extrusion, onto the embryonic web and/or dried fibrous structure, and/or by gravure printing onto the embryonic web and/or dried fibrous structure.

Exemplary art related to the former path categorized by adding chemical softeners to the tissue paper prior to its assembly into a web includes U.S. Pat. No. 5,264,082 issued to Phan and Trokhan on Nov. 23, 1993, incorporated herein by reference. Such methods have found broad use in the industry especially when it is desired to reduce the strength which would otherwise be present in the paper and when the papermaking process, particularly the creping operation, is robust enough to tolerate incorporation of the bond inhibiting agents.

Further exemplary art related to the addition of chemical softeners to the tissue paper web during its formation includes U.S. Pat. No. 5,059,282 issued to Ampulski, et. al. on Oct. 22, 1991 incorporated herein by reference. The Ampulski patent discloses a process for adding a polysiloxane compound to a wet tissue web (preferably at a fiber consistency between about 20% and about 35%). Such a method represents an advance in some respects over the addition of chemicals into the slurry vats supplying the papermaking machine. For example, such means target the application to one of the web surfaces as opposed to distributing the additive onto all of the fibers of the furnish.

Considerable art has been devised to apply chemical softeners to already-dried paper webs either at the so-called dry end of the papermaking machine or in a separate converting operation subsequent to the papermaking step. Exemplary art from this field includes U.S. Pat. No. 5,215,626 issued to Ampulski, et. al. on Jun. 1, 1993; U.S. Pat. No. 5,246,545 issued to Ampulski, et. al. on Sep. 21, 1993; and U.S. Pat. No. 5,525,345 issued to Warner, et. al. on Jun. 11, 1996, all incorporated herein by reference. The U.S. Pat. No. 5,215,626 discloses a method for preparing soft tissue paper by applying a polysiloxane to a dry web. The U.S. Pat. No. 5,246,545 discloses a similar method utilizing a heated transfer surface. Finally, the Warner Patent discloses methods of application including roll coating and extrusion for applying particular compositions to the surface of a dry tissue web.

i. Quaternary Ammonium Softeners

Particularly preferred chemical softening ingredients are further detailed as follows:

Preferably, quaternary ammonium compounds suitable to serve as chemical softening agents of the present invention have the formula:

$$(R^1)_{4-m}—N+—[R^2]_m X^-$$

wherein:

m is 1 to 3; each $R^1$ is independently a $C_1$-$C_6$ alkyl group, hydroxyalkyl group, hydrocarbyl or substituted hydrocarbyl group, alkoxylated group, benzyl group, or mixtures thereof; each $R^2$ is independently a $C_{14}$-$C_{22}$ alkyl group, hydroxyalkyl group, hydrocarbyl or substituted hydrocarbyl group, alkoxylated group, benzyl group, or mixtures thereof; and $X^-$is any softener-compatible anion are suitable for use in the present invention.

Preferably, each $R^1$ is methyl and $X^-$is chloride or methyl sulfate. Preferably, each $R^2$ is independently $C_{16}$-$C_{18}$ alkyl or alkenyl, most preferably each $R^2$ is independently straight-chain $C_{18}$ alkyl or alkenyl.

Particularly preferred variants of these softening agents are what are considered to be mono or diester variations of these quaternary ammonium compounds having the formula:

$$(R^1)_{4-m}—N+—[(CH_2)_n—Y—R^3]_m X^-$$

wherein:

Y is —O—(O)C—, or —C(O)—O—, or —NH—C(O)—, or —C(O)—NH—; m is 1 to 3; n is 0 to 4; each $R^1$ is independently a $C_1$-$C_6$ alkyl group, hydroxyalkyl group, hydrocarbyl or substituted hydrocarbyl group, alkoxylated group, benzyl group, or mixtures thereof; each $R^3$ is independently a $C_{13}$-$C_{21}$ alkyl group, hydroxyalkyl group, hydrocarbyl or substituted hydrocarbyl group, alkoxylated group, benzyl group, or mixtures thereof, and $X^-$is any softener-compatible anion.

Preferably, Y is —O—(O)C—, or —C(O)—O—; m=2; and n=2. Each $R^1$ is independently preferably a $C_1$-$C_3$, alkyl group, with methyl being most preferred. Preferably, each $R^3$ is independently $C_{13}$-$C_{17}$ alkyl and/or alkenyl, more preferably $R^3$ is independently straight chain $C_{15}$-$C_{17}$ alkyl and/or alkenyl, $C_{15}$-$C_{17}$ alkyl, most preferably each $R^3$ is independently straight-chain $C_{17}$ alkyl.

As mentioned above, $X^-$ can be any softener-compatible anion, for example, acetate, chloride, bromide, methyl sulfate, formate, sulfate, nitrate and the like can also be used in the present invention. Preferably $X^-$ is chloride or methyl sulfate.

One particularly preferred material is so-called DEEDMAMS (diethyl ester dimethyl ammonium methyl sulfate), further defined herein wherein the hydrocarbyl chains are derived from tallow fatty acids optionally partially hardened to an iodine value from about 10 to about 60.

Also acceptable are the quaternary imidoazoline quaternary surfactants of the general formula:

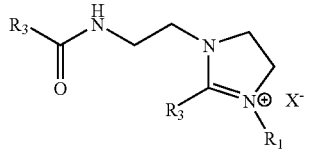

as are diamidoamine quaternary ammonium surfactants of the general formula:

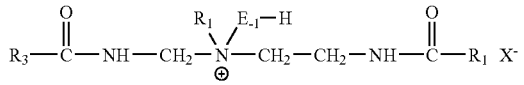

as are amino acid salts; linear amine amides; mixtures of the foregoing classes. In each of the foregoing formulas $R_1$ and $R_2$ are methyl, ethyl, or hydroxy ethyl; $R_3$ and $R_4$ are hydrocarbons having 7 to 40 carbon atoms; E is an ethoxy or propoxy group; m is an interger from 1 to 20; n is an interger from 0 to 20; and, $X^-$ can be any softener-compatible anion, for example, acetate, chloride, bromide, methyl sulfate, formate, sulfate, nitrate and the like. Preferably $X^-$is chloride or methyl sulfate.

U.S. Pat. Nos. 6,547,928; 6,579,416; and 6,607,637 issued to Vinson et. al. also describe particularly preferred formulations including quaternary surfactants acceptable for use in the present invention.

ii. Emollient Lotion Composition

Suitable chemical softening agents as defined herein may include emollient lotion compositions. As used herein, an "emollient lotion composition" is a chemical softening agent that softens, soothes, supples, coats, lubricates, or moisturizes the skin. An emollient typically accomplishes several of these objectives such as soothing, moisturizing, and lubricating the skin.

Emollients useful in the present invention can be petroleum-based, fatty acid ester type, alkyl ethoxylate type, or mixtures of these emollients. Suitable petroleum-based emollients include those hydrocarbons, or mixtures of hydrocarbons, having chain lengths of from 16 to 32 carbon atoms. Petroleum based hydrocarbons having these chain lengths include mineral oil (also known as "liquid petrolatum") and petrolatum (also known as "mineral wax," "petroleum jelly" and "mineral jelly"). Mineral oil usually refers to less viscous mixtures of hydrocarbons having from 16 to 20 carbon atoms. Petrolatum usually refers to more viscous mixtures of hydrocarbons having from 16 to 32 carbon atoms. Petrolatum is a particularly preferred emollient for use in fibrous structures that are incorporated into toilet tissue products. and a suitable material is available from Witco, Corp., Greenwich, Conn. as White Protopet® IS. Mineral oil is also a preferred emollient for use in fibrous structures that are incorporated into facial tissue products. Such mineral oil is commercially available also from Witco Corp.

Suitable fatty acid ester type emollients include those derived from $C_{12}$-$C_{28}$ fatty acids, preferably $C_{16}$-$C_{22}$ saturated fatty acids, and short chain ($C_1$-$C_8$, preferably $C_1$-$C_3$) monohydric alcohols. Representative examples of such esters include methyl palmitate, methyl stearate, isopropyl laurate, isopropyl myristate, isopropyl palmitate, and ethylhexyl palmitate. Suitable fatty acid ester emollients can also be derived from esters of longer chain fatty alcohols ($C_{12}$-$C_{28}$, preferably $C_{12}$-$C_{16}$) and shorter chain fatty acids e.g., lactic acid, such as lauryl lactate and cetyl lactate.

Suitable alkyl ethoxylate type emollients include $C_{12}$-$C_{18}$ fatty alcohol ethoxylates having an average of from 3 to 30 oxyethylene units, preferably from about 4 to about 23. Representative examples of such alkyl ethoxylates include laureth-3 (a lauryl ethoxylate having an average of 3 oxyethylene units), laureth-23 (a lauryl ethoxylate having an average of 23 oxyethylene units), ceteth-10 (acetyl ethoxylate having an average of 10 oxyethylene units) and steareth-10 (a stearyl ethoxylate having an average of 10 oxyethylene units). These alkyl ethoxylate emollients are typically used in combination with the petroleum-based emollients, such as petrolatum, at a weight ratio of alkyl ethoxylate emollient to petroleum-based emollient of from about 1:1 to about 1:3, preferably from about 1:1.5 to about 1:2.5.

Emollient lotion compositions may optionally include an "immobilizing agents", so-called because it is believed to act to prevent migration of the emollient so that it can remain primarily on the surface of the paper structure to which it is applied so that it may deliver maximum softening benefit as well as be available for transferability to the users' skin. Suitable immobilizing agents for the present invention can comprise polyhydroxy fatty acid esters, polyhydroxy fatty acid amides, and mixtures thereof. To be useful as immobilizing agents, the polyhydroxy moiety of the ester or amide has to have at least two free hydroxy groups. It is believed that these free hydroxy groups are the ones that co-crosslink through hydrogen bonds with the cellulosic fibers of the tissue paper web to which the lotion composition is applied and homo-crosslink, also through hydrogen bonds, the hydroxy groups of the ester or amide, thus entrapping and immobilizing the other components in the lotion matrix. Preferred esters and amides will have three or more free hydroxy groups on the polyhydroxy moiety and are typically nonionic in character. Because of the skin sensitivity of those using paper products to which the lotion composition is applied, these esters and amides should also be relatively mild and non-irritating to the skin.

Suitable polyhydroxy fatty acid esters for use in the present invention will have the formula:

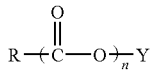

wherein R is a $C_5$-$C_{31}$ hydrocarbyl group, preferably straight chain $C_7$-$C_{19}$ alkyl or alkenyl, more preferably straight chain $C_9$-$C_{17}$ alkyl or alkenyl, most preferably straight chain $C_{11}$-$C_{17}$ alkyl or alkenyl, or mixture thereof; Y is a polyhydroxyhydrocarbyl moiety having a hydrocarbyl chain with at least 2 free hydroxyls directly connected to the chain; and n is at least 1. Suitable Y groups can be derived from polyols such as glycerol, pentaerythritol; sugars such as raffinose, maltodextrose, galactose, sucrose, glucose, xylose, fructose, maltose, lactose, mannose and erythrose; sugar alcohols such as erythritol, xylitol, malitol, mannitol and sorbitol; and anhydrides of sugar alcohols such as sorbitan.

One class of suitable polyhydroxy fatty acid esters for use in the present invention comprises certain sorbitan esters, preferably the sorbitan esters of $C_{16}$-$C_{22}$ saturated fatty acids. Because of the manner in which they are typically manufactured, these sorbitan esters usually comprise mixtures of mono-, di-, tri-, etc. esters. Representative examples of suitable sorbitan esters include sorbitan palmitates (e.g., SPAN 40), sorbitan stearates (e.g., SPAN 60), and sorbitan behenates, that comprise one or more of the mono-, di- and tri-ester versions of these sorbitan esters, e.g., sorbitan mono-, di- and tri-palmitate, sorbitan mono-, di- and tri-stearate, sorbitan mono-, di and ri-behenate, as well as mixed tallow fatty acid sorbitan mono-, di- and tri-esters. Mixtures of different sorbitan esters can also be used, such as sorbitan palmitates with sorbitan stearates. Particularly preferred sorbitan esters are the sorbitan stearates, typically as a mixture of mono-, di- and tri-esters (plus some tetraester) such as SPAN 60, and sorbitan stearates sold under the trade name GLYCOMUL-S by Lonza, Inc. Although these sorbitan esters typically contain mixtures of mono-, di- and tri-esters, plus some tetraester, the mono- and di-esters are usually the predominant species in these mixtures.

iii. Polysiloxanes and/or other Silicone Materials

Other suitable chemical softening agents suitable for the invention include silicone materials, such as polysiloxane compounds, cationic silicones, quaternary silicone compounds and/or aminosilicones. In general, suitable polysiloxane materials for use in the present invention include those having monomeric siloxane units of the following structure:

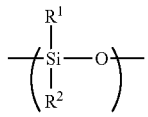

wherein, $R^1$ and R2, for each independent siloxane monomeric unit can each independently be hydrogen or any alkyl, aryl, alkenyl, alkaryl, arakyl, cycloalkyl, halogenated hydrocarbon, or other radical. Any of such radicals can be substituted or unsubstituted. $R^1$ and $R^2$ radicals of any particular monomeric unit may differ from the corresponding functionalities of the next adjoining monomeric unit. Additionally, the polysiloxane can be either a straight chain, a branched chain or have a cyclic structure. The radicals $R^1$ and $R^2$ can additionally independently be other silaceous functionalities such as, but not limited to siloxanes, polysiloxanes, silanes, and polysilanes. The radicals $R^1$ and $R^2$ may contain any of a variety of organic functionalities including, for example, alcohol, carboxylic acid, phenyl, and amine functionalities.

Exemplary alkyl radicals are methyl, ethyl, propyl, butyl, pentyl, hexyl, octyl, decyl, octadecyl, and the like. Exemplary alkenyl radicals are vinyl, allyl, and the like. Exemplary aryl radicals are phenyl, diphenyl, naphthyl, and the like. Exemplary alkaryl radicals are toyl, xylyl, ethylphenyl, and the like. Exemplary aralkyl radicals are benzyl, alpha-phenylethyl, beta-phenylethyl, alpha-phenylbutyl, and the like. Exemplary cycloalkyl radicals are cyclobutyl, cyclopentyl, cyclohexyl, and the like. Exemplary halogenated hydrocarbon radicals are chloromethyl, bromoethyl, tetrafluorethyl, fluorethyl, trifluorethyl, trifluorotloyl, hexafluoroxylyl, and the like.

Preferred polysiloxanes include straight chain organopolysiloxane materials of the following general formula:

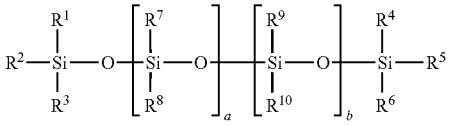

wherein each $R^1$-$R^9$ radical can independently be any $C_1$-$C_{10}$ unsubstituted alkyl or aryl radical, and $R^{10}$ of any substituted $C_1$-$C_{10}$ alkyl or aryl radical. Preferably each $R^1$-$R^9$ radical is independently any $C_1$-$C_4$ unsubstituted alkyl group. those skilled in the art will recognize that technically there is no difference whether, for example, $R^9$ or $R^{10}$ is the substituted radical. Preferably the mole ratio of b to (a+b) is between 0 and about 20%, more preferably between 0 and about 10%, and most preferably between about 1% and about 5%.

In one particularly preferred embodiment, $R^1$-$R^9$ are methyl groups and $R^{10}$ is a substituted or unsubstituted alkyl, aryl, or alkenyl group. Such material shall be generally described herein as polydimethylsiloxane which has a particular functionality as may be appropriate in that particular case. Exemplary polydimethylsiloxane include, for example, polydimethylsiloxane having an alkyl hydrocarbon $R^{10}$ radical and polydimethylsiloxane having one or more amino, carboxyl, hydroxyl, ether, polyether, aldehyde, ketone, amide, ester, thiol, and/or other functionalities including alkyl and alkenyl analogs of such functionalities. For example, an amino functional alkyl group as $R^{10}$ could be an amino functional or an aminoalkyl-functional polydimethylsiloxane. The exemplary listing of these polydimethylsiloxanes is not meant to thereby exclude others not specifically listed.

Viscosity of polysiloxanes useful for this invention may vary as widely as the viscosity of polysiloxanes in general vary, so long as the polysiloxane can be rendered into a form which can be applied to the tissue paper product herein. This includes, but is not limited to, viscosity as low as about 25 centistokes to about 20,000,000 centistokes or even higher.

While not wishing to be bound by theory, it is believed that the tactile benefit efficacy is related to average molecular weight and that viscosity is also related to average molecular weight. Accordingly, due to the difficulty of measuring molecular weight directly, viscosity is used herein as the apparent operative parameter with respect to imparting softness to tissue paper.

References disclosing polysiloxanes include U.S. Pat. No. 2,826,551, issued to Geen on Mar. 11, 1958; U.S. Pat. No. 3,964,500, issued to Drakoff on Jun. 22, 1976; U.S. Pat. No. 4,364,837, issued to Pader on Dec. 21, 1982; U.S. Pat. No. 5,059,282, issued to Ampulski; U.S. Pat. No. 5,529,665 issued to Kaun on Jun. 25, 1996; U.S. Pat. No. 5,552,020 issued to Smithe et al. on Sep. 3, 1996; and British Patent 849,433, published on Sep. 28, 1960 in the name of Wooston. All of these patents are incorporated herein by reference. Also incorporated herein by reference is Silicone Compounds, pp. 181-217, distributed by Petrach Systems, Inc., which contains an extensive listing and description of polysiloxanes in general.

In one embodiment, the chemical softeners may be mixed with the fibers, especially the short fibers to form the fibrous furnish, especially the short fiber furnish.

In another embodiment, the chemical softeners may be applied to the embryonic fibrous web and/or the TAD fibrous structure. Application of the chemical softener to the embryonic fibrous web and/or TAD fibrous structure may be by any suitable process known to those of ordinary skill in the art. Nonlimiting examples of such application processes include spraying the chemical softener onto the embryonic fibrous web and/or TAD fibrous structure and/or extruding the chemical softener onto the embryonic fibrous web and/or TAD fibrous structure. Other application processes include brushing the chemical softener onto the embryonic fibrous web and/or TAD fibrous structure and/or dipping the embryonic fibrous web and/or TAD fibrous structure in the chemical softener.

Optional Ingredients:

The TAD fibrous structure of the present invention may comprise an optional ingredient selected from the group consisting of temporary wet strength resins, dry strength resins, wetting agents, lint resisting agents, absorbency-enhancing agents, immobilizing agents, especially in combination with emollient lotion compositions, antiviral agents including organic acids, antibacterial agents, polyol polyesters, antimigration agents, polyhydroxy plasticizers and mixtures thereof. Such optional ingredients may be added to the fiber furnish, the embryonic fibrous web and/or the TAD fibrous structure.

Such optional ingredients may be present in the TAD fibrous structure at any level based on the dry weight of the TAD fibrous structure.

The optional ingredients may be present in the TAD fibrous structure at a level of from about 0.001 to about 50% and/or from about 0.001 to about 20% and/or from about 0.01 to about 5% and/or from about 0.03 to about 3% and/or from about 0.1 to about 1.0% by weight, on a dry TAD fibrous structure basis.

i. Temporary Wet Strength Additives

One method of delivering fugitive wet strength is to provide for the formation of acid-catalysed hemiacetal formation through the introduction of ketone or, more specifically aldehyde functional groups on the papermaking fibers or in a binder additive for the papermaking fibers. One binder material that has been found particularly useful for imparting this form of fugitive wet strength is Parez 750 offered by Cytec of Stamford, Conn.

Other additives can also be used to augment this wet strength mechanism. This technique for delivering fugitive wet strength is well known in the art. Exemplary art, incorporated herein by reference for the purpose of showing methods of delivering the fugitive wet strength to the web, includes the following U.S. Pat. Nos. 5,690,790; 5,656,746; 5,723, 022; 4,981,557; 5,008,344; 5,085,736; 5,760,212; 4,605,702; 6,228,126; 4,079,043; 4,035,229; 4,079,044; and 6,127,593.

While the hemiacetal formation mechanism is one suitable technique for generating temporary wet strength, there are other methods, such as providing the sheet with a binder mechanism which is more active in the dry or slightly wet condition than in the condition of high dilution as would be experienced in the toilet bowl or in the subsequent sewer and septic system. Such methods have been primarily directed at web products which are to be delivered in a slightly moist or wet condition, then will be disposed under situation of high dilution. The following references are incorporated herein by reference for the purpose of showing exemplary systems to accomplish this, and those skilled in the art will readily recognize that they can be applied to the webs of the present invention which will be supplied generally at lower moisture content than those described therewithin: U.S. Pat. Nos. 4,537,807; 4,419,403; 4,309,469; and 4,362,781.

ii. Dry Strength Additives

Nonlimiting examples of dry strength resins include polyacrylamides (such as combinations of CYPRO 514 and ACCOSTRENGTH 711 produced by Cytec of Stamford Conn.; starch, for example corn starch and/or potato starch (such as REDIBOND 5320 and 2005) available from National Starch and Chemical Company, Bridgewater, N.J.; polyvinyl alcohol (such as AIRVOL® 540 produced by Air Products Inc of Allentown, Pa.); guar or locust bean gums; and/or carboxymethyl cellulose (such as CMC from Hercules, Inc. of Wilmington, Del.). Dry strength additives are used in more or less amounts to control tensile strength and lint levels.

iii. Wetting Agents

Nonlimiting examples of wetting agents suitable for use in the present invention include polyhydroxy compounds, such as glyercol and polyglycols, and nonionic surfactants, such as addition products of ethylene oxide and, optionally, propylene oxide, with fatty alcohols, fatty acids and fatty amines.

The above listing of optional ingredients is intended to be merely exemplary in nature, and is not meant to limit the scope of the invention.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for foreshortening a fibrous structure, the process comprising the steps of:

a. forming a wet fibrous structure comprising greater than 60% moisture;

b. drying the wet fibrous structure such that a dried fibrous structure comprising less than 20% moisture is formed; and c. dry-end foreshortening the dried fibrous structure by an amount less than about 48%+[14.5%×ln(BW/MDT)].

2. The process according to claim 1 wherein the process further comprises the step of transferring the dried fibrous structure to a reel via a conveyor system comprising at least one conveyor.

3. The process according to claim 2 wherein the fibrous structure at the reel exhibits a caliper that is greater than the caliper of the dried fibrous structure at the point of transfer of said dried fibrous structure to said conveyor system.

4. A fibrous structure made by the process according to claim 1.

5. A sanitary tissue product comprising a fibrous structure according to claim 4.

* * * * *

UNITED STATES PATENT AND TRADEMARK OFFICE

CERTIFICATE OF CORRECTION

PATENT NO. : 7,758,723 B2
APPLICATION NO. : 11/799932
DATED : July 20, 2010
INVENTOR(S) : Kenneth Douglas Vinson et al.

It is certified that error appears in the above-identified patent and that said Letters Patent is hereby corrected as shown below:

In Col. 9, line 61, the word "Tinting" should be linting

Signed and Sealed this
Eleventh Day of January, 2011

David J. Kappos

David J. Kappos
*Director of the United States Patent and Trademark Office*